US006156987A

United States Patent [19]

Warne

[11] Patent Number: 6,156,987

[45] Date of Patent: Dec. 5, 2000

[54] SUBMERSIBLE TOUCH-OPERATED SIGNALER WITH FLUID DRAINAGE PASSAGES

[75] Inventor: Jason C. Warne, Brookings, S. Dak.

[73] Assignee: Daktronics, Inc., Brookings, S. Dak.

[21] Appl. No.: 09/386,011

[22] Filed: Aug. 30, 1999

[51] Int. Cl.[7] ..... H01H 1/10

[52] U.S. Cl. ..... 200/512; 200/52 R

[58] Field of Search ..... 250/86 R, 85 A, 250/86 B; 473/467

[56] References Cited

U.S. PATENT DOCUMENTS 3,745,275 7/1973 Degiez ..... 200/52 R 3,784,768 1/1974 Hunt ..... 200/52 R

*Primary Examiner*—Lincoln Donovan

*Assistant Examiner*—Nhung Nguyen

*Attorney, Agent, or Firm*—Hugh D. Jaeger

[57] ABSTRACT

A submersible, touch-operated signaler including at least a pair of facially confronting, electrically conductive plates. Strips of resilient, nonconductive material are interposed between the plates to maintain a substantially preset spacing therebetween and to yieldably resist movement of the plates toward each other. The strips are disposed in a plurality of vertically aligned and spaced rows with vertically aligned fluid-draining passages therebetween. Rigid edge containment brackets along adjacent margins of the plates secure the edges of the plates against movement away from each other. Openings extend through a rear electrically conductive plate which align with the vertically oriented passages between the resilient strips to provide free vertical fluid flow into and out of the space between the plates. The touch-operated signaler operates on low voltage.

2 Claims, 7 Drawing Sheets

SUBMERSIBLE TOUCH-OPERATED SIGNALER WITH FLUID DRAINAGE PASSAGES

CROSS REFERENCES TO CO-PENDING APPLICATIONS

None.

BACKGROUND OF THE INVENTION

1. Field of the Invention

The present invention is for a submersible touch-operated signaler, and is an improvement to the submersible touch-operated signaler disclosed in U.S. Pat. No. 3,784,768 to Hunt.

2. Description of the Prior Art

Various forms of submersible touch-operated signalers have been produced in the past. These may include signalers placed at the ends of swimming lanes in a pool, which are touched by swimmers to signal the completion of laps or a race. Generally, such signalers include a pair of spaced-apart contact elements which, when pressed into contact with each other, complete an electrical connection to produce a signal. In such devices, it may be desirable to provide resilient, nonconductive spacers between the conductive plates, which spacers must be forcibly compressed to produce contact between the members. Further, it is often desirable to provide some means for maintaining a level of fluid between the contact plates which is substantially equivalent to the level of fluid surrounding the signaler. With the fluid level between the plates substantially equivalent to the level of the fluid surrounding the plates, the effect of fluid pressure and wave action on the outside of the plates is minimized.

A difficulty with previously-designed signalers, has been that often the spacers used between the plates have impeded the flow of fluid into and out of the space between the plates. This can be a problem, especially when it is desired to remove the signaler from a body of fluid in which it is immersed. Explaining further, such signalers may be rather large, and if they do not drain rapidly, they are extremely heavy, unwieldy, and difficult to remove from a body of fluid, such as a swimming pool. In the prior art, drain openings were provided in a securing plate located along the lower edge margins of the spaced-apart contact plates. Often in assembling the signaler, the drain openings were not aligned with the small gaps between the spacers and as a result fluid flow was impeded or slowed to some extent. If complete drainage did not occur, then permanent damage could occur.

Another difficulty with prior art touch-operated signalers is corrosion of the plates causing intermittent, faulty or otherwise unsuitable electrical contact between the plates when manually depressed by a swimmer. It has been discovered that the main cause of such corrosion is the utilization of excessive operating voltage.

SUMMARY OF THE INVENTION

The general purpose of the present invention is a submersible touch-operated signaler.

According to one embodiment of the present invention, there is provided a submersible touch-operated signaler including planar plates which are closely spaced and which are separated by vertically oriented staggered and spaced resilient tape strips defining vertically aligned spaces between the plates in which pool water is distributed and flows. One or more plates, which are flexible, are depressed by the swimmer to complete a 0.25 volt direct current signaling circuit. The staggering of the tape strips between adjacent plates provides for electrical contact between the plates regardless of the point of contact by the swimmer. Removal of the submersible touch-operated signaler from the pool water is facilitated by the vertical spaces between the plates which rapidly drain through drain openings in the bottom of the back contact plate of the structure.

One significant aspect and feature of the present invention is a submersible touch-operated signaler having fluid drainage passages.

Another significant aspect and feature of the present invention is a submersible touch-operated signaler having vertical spaces and aligned drain openings which facilitate rapid and complete drainage of fluid from the interior thereof.

Still another significant aspect and feature of the present invention is a submersible touch-operated signaler having a plurality of planar plates in close proximity to one another.

Yet another significant aspect and feature of the present invention is a submersible touch-operated signaler in which a signaling contact is completed regardless of where the signaler is manually contacted.

A further significant aspect and feature of the present invention is a submersible touch-operated signaler which is substantially immune to plate corrosion.

A still further significant aspect and feature of the present invention is a submersible touch-operated signaler which operates on 0.25 volt direct current and in a range of 0.01 to 0.70 volt direct current.

Having thus described significant aspects and features of the present invention, it is the principal object of the present invention to provide a submersible touch-operated signaler which is immune to corrosion.

A general object of the invention, therefore, is to provide a novel, submersible touch-operated signaler, including a plurality of spaced apart corrosion-resistant contact members in close proximity, which is simply and economically constructed, and which provides for the rapid flow of fluid into and out of a region between the contact members.

More specifically, an object of the invention is to provide such a signaler having two or more facially confronting, spaced-apart plates which are yieldably held in spaced-apart relation by a plurality of resilient tape spacers secured between the plates. The edges of the plates are secured against movement away from each other by means extending along the edges of the plates. The spacers may be strips of nonconductive material which are so disposed between the plates that they provide vertically extending spaces or passages which substantially align with drain openings in the lower region of the back contact plate of the submersible touch-operated signaler to provide for the free flow of fluid vertically into and out of the spaced regions between the plates. Reliability and substantially corrosion-free operation is attained primarily by low voltage switch operation at 0.25 volt direct current instead of utilizing corrosion causing higher operating voltages.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
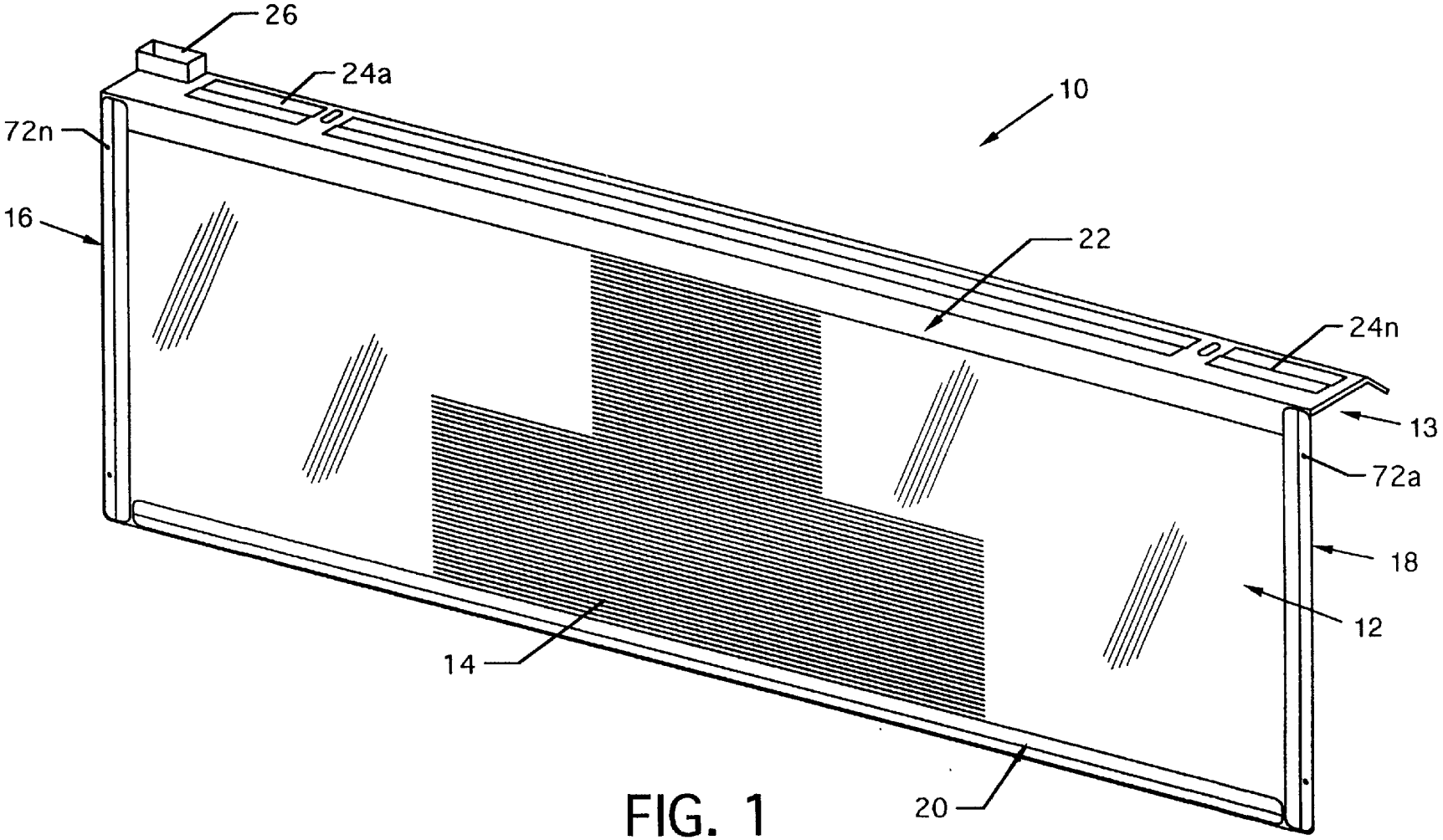
FIG. 1 illustrates a perspective view of a submersible touch-operated signaler constructed according to an embodiment of the invention.

Referring now to the drawings, and first more specifically to FIG. 1, indicated generally is a submersible touch-operated signaler 10 which may be secured to the wall of a swimming pool at the end of a swimming lane, or hung on the lip of the pool. The touch-operated signaler is such as may be used to produce an electrical signal to a timing device when touched by a swimmer at the end of a lap or a race. The touch-operated signaler 10 includes a planar rectangular touch area 12 comprised of layered materials, as later described in detail, including a highly visible target area 14 central to the touch area. An upper support region 13 includes components perpendicular to the touch area 12. Other readily visible components of the touch-operated signaler 10 include opposing vertically aligned edge containment brackets 16 and 18 extending along the vertical edges of the touch area 12, a horizontally aligned edge containment bracket 20 extending along the lower horizontal edge of the touch area 12, a horizontally aligned protective neoprene boot 22 extending along the top horizontal edge of the touch area 12, a plurality of upper edge containment brackets 24*a*–24*n*, and a terminal enclosure box 26.

Figure 2:
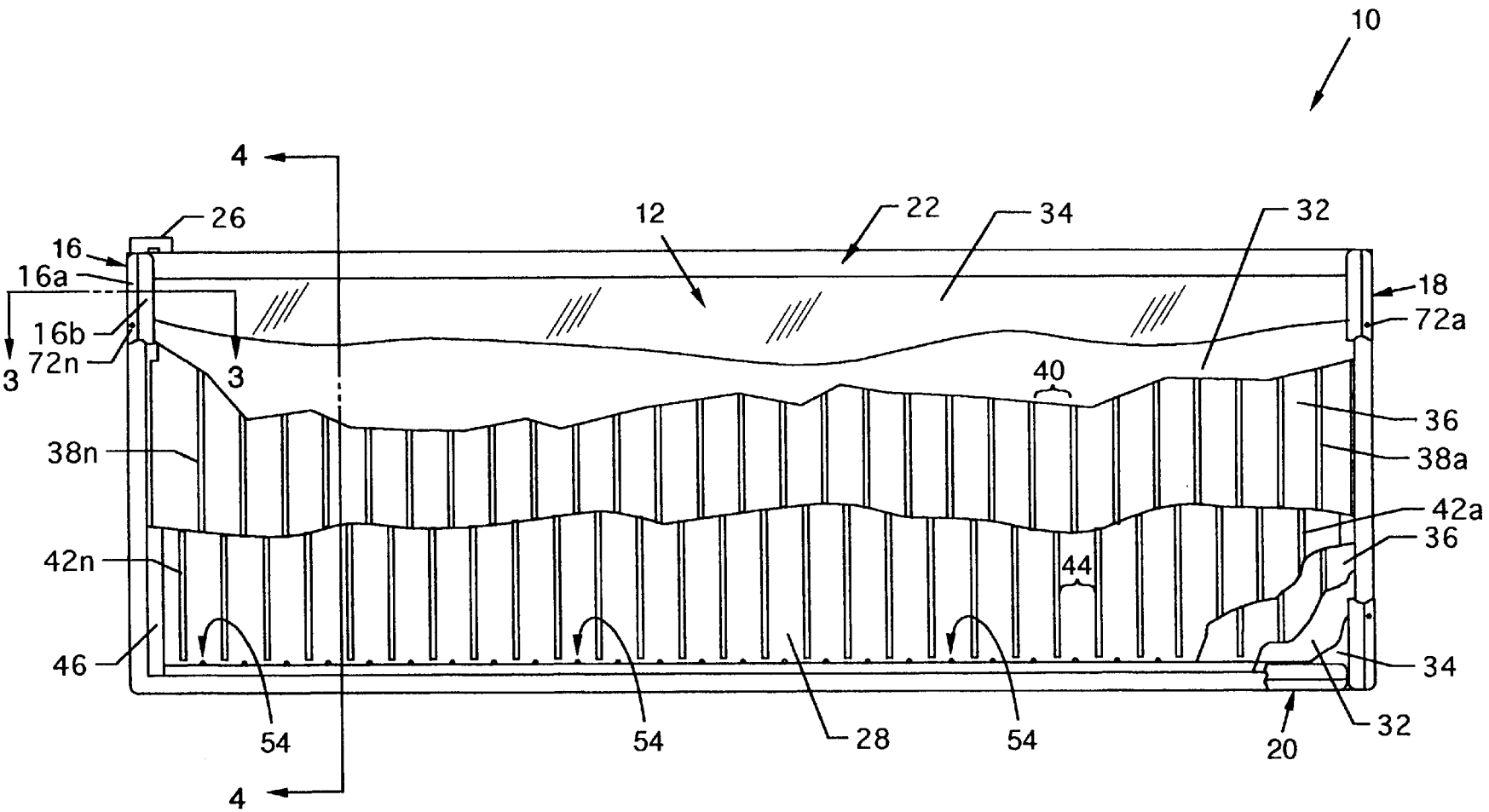
FIG. 2 is a front view of the submersible touch-operated signaler with portions broken away.
Figure 3:
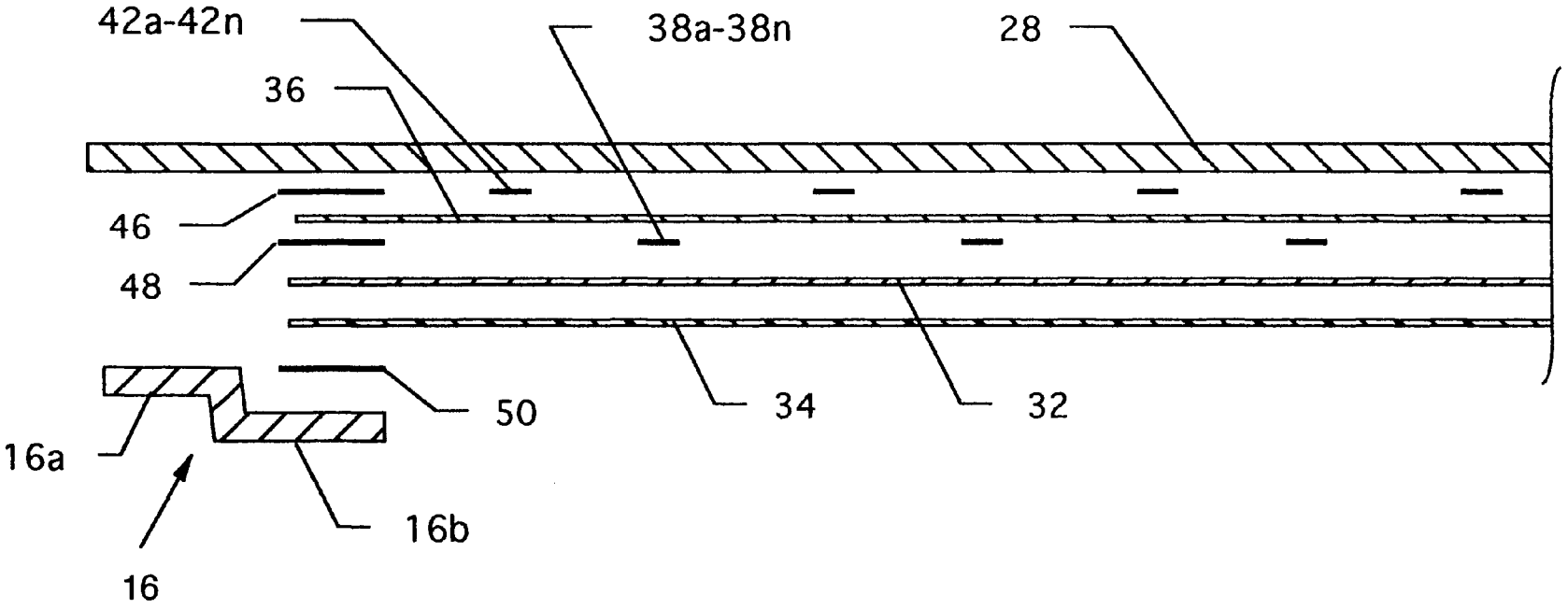
FIG. 3 is an enlarged cross sectional exploded view taken along the line 3—3 in FIG. 2.
Figure 4:
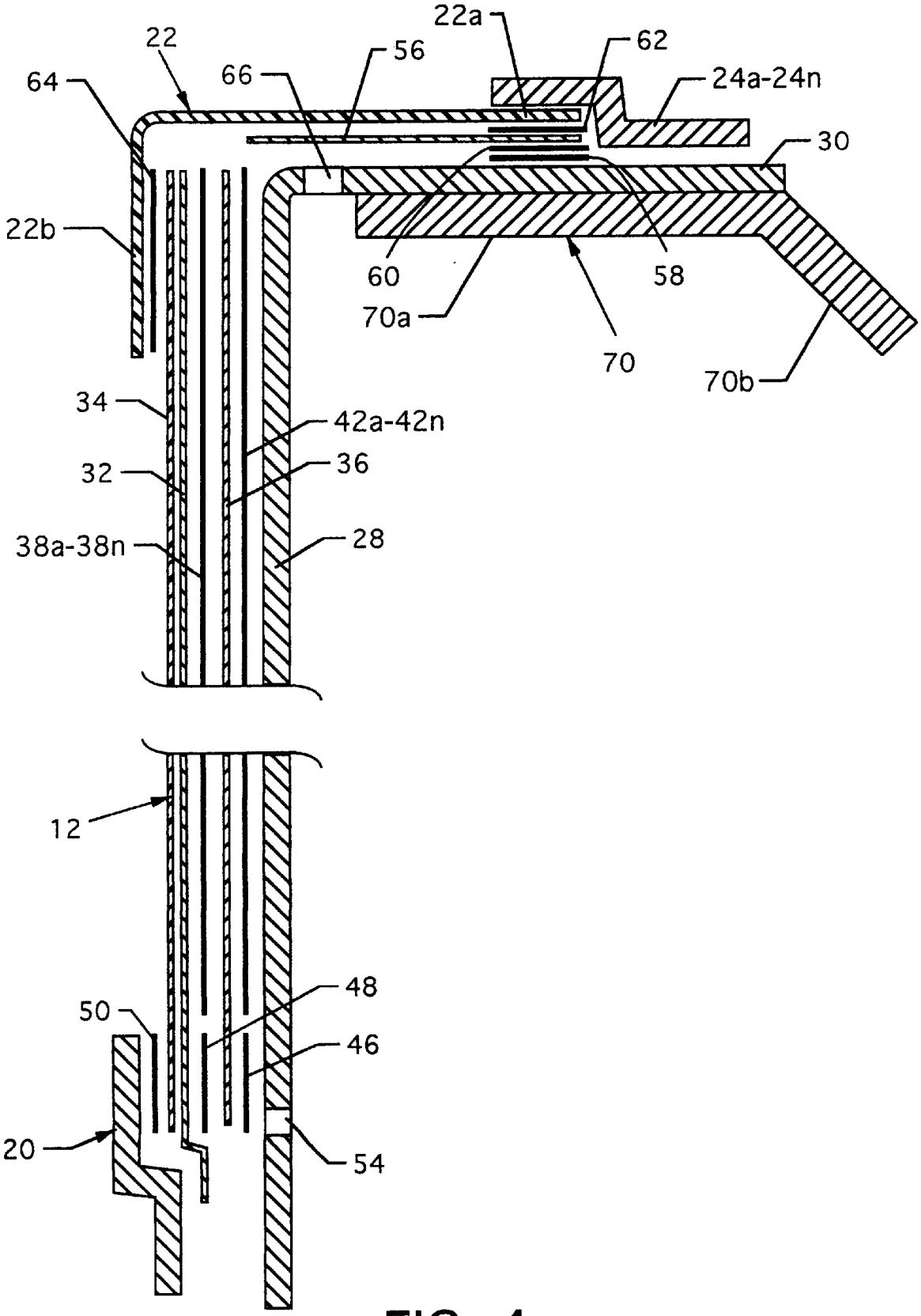
FIG. 4 is an enlarged cross sectional exploded view taken generally along the line 4—4 in FIG. 2.

Referring now to FIGS. 2–4, the touch-operated signaler 10 includes an upright, substantially rigid planar and rectangular-shaped back plate 28 and a planar rectangular shaped top plate 30 which extends rearwardly at a right angle from the back plate 28, as is best seen in FIG. 4. A planar rectangular, upright face plate 32, having dimensions which are slightly smaller than the dimensions of the back plate 28, is spaced forwardly from the back plate 28 and forms a front face for the touch-operated signaler 10. A film 34 upon which the target area 14 is imprinted is adhesively applied over the outwardly facing surface of the face plate 32. Another, or intermediate, planar rectangular plate 36, having substantially the same dimensions as face plate 32, is interposed between, and spaced from, both the face plate 32 and the back plate 28. The opposite ends and bottom edge of the intermediate plate 36 are coextensive with the opposite ends and bottom edge of the face plate 32, as is best seen in FIGS. 2 and 4.

The back plate 28 is formed of a substantially rigid sheet of conductive, noncorroding material, such as passivated stainless steel. The face plate 32 and intermediate plate 36 also are formed of a conductive, noncorroding material, such as passivated stainless steel, but are of thinner sheet material which may be flexed when lightly touched. As an example of the thicknesses of steel of which may be used, the back plate 28 may be formed of material which is 0.050 inch thick, and the face and intermediate plates 32 and 36, respectively, may be formed of material which is 0.008 inch thick.

As is best seen in FIGS. 3 and 4, the face plate 32 and the intermediate plate 36 are held in a normally spaced relation by a plurality of nonconductive spacer means in the form of resilient material tape strips 38*a*–38*n*. The tape strips 38*a*–38*n* may be thin strips of urethane foam tape which have adhesive material on both of their plate-contacting surfaces. The tape strips 38*a*–38*n*, being all equal in length, are disposed in a vertical orientation to present an array of vertically aligned and horizontally spaced rows, as shown in FIG. 2. The tape strips 38*a*–38*n* in each row are spaced apart somewhat to form a plurality of spaces, such as those indicated generally at 40, between tape strips 38*a*–38*n*. The tape strips 38*a*–38*n* are so disposed in the region bounded by the face plate 32 and the intermediate plate 36 that the spaces 40 between the face and intermediate plates 32 and 36 are substantially vertically aligned to provide vertical passages for fluid flow between the top and bottom regions of the submersible touch-operated signaler 10.

The tape strips 38*a*–38*n* are sufficiently resilient that a light touch on face plate 32 between strips 38*a*–38*n* will deflect the face plate 32 into contact with the intermediate plate 36. Upon release of such touch, the face and intermediate plates 32 and 36 return to their spaced-apart relationship.

A similar set of elongated tape strips 42*a*–42*n* are adhesively bonded between the back plate 28 and intermediate plate 36. Tape strips 42*a*–42*n*, like tape strips 38*a*–38*n*, may be formed of a urethane foam tape which has an adhesive material on both of its plate-contacting surfaces. Tape strips 42*a*–42*n* also are disposed in vertical orientation to present an array of vertically aligned and horizontally spaced rows. Spaces 44 are provided between adjacent tape strips 42*a*–42*n* in a row, and the spaces 44 in each row are substantially aligned with spaces 44 in adjoining rows to provide an array of vertical passages extending from top to bottom in the region between the back and intermediate plates 28 and 36. As is best seen in FIGS. 2 and 3, the vertical positioning of tape strips 42*a*–42*n* is staggered with relation to the vertical positioning of tape strips 38*a*–38*n* to form a staggered relationship between arrayed spaces 40 and 44 which lie in adjacent and parallel planes.

Referring now to FIGS. 3 and 4, these cross sectional exploded views illustrate the manner in which vertical edge margins of the plates 32, 36 and 28 and the bottom edge margins of the plates 32, 36 and 28 are secured against movement outwardly or downwardly and away from each other. With reference to FIG. 3, a strip of nonconductive tape 46 is secured between the vertical edge margins of the intermediate plate 36 and the back plate 28, a strip of nonconductive tape 48 is secured between the vertical edge margins of the front plate 32 and the intermediate plate 36, and a layer of nonconductive tape 50 is secured to the vertical edge margin of the film 34 overlying the outer face of the face plate 32 adjacent its vertical edge margin.

An elongated substantially rigid angle member, or edge containment bracket 16, having angularly disposed legs 16*a*, 16*b*, overlies the layered vertical edge margins of the plates 32, 36 and 28, and the previously-described nonconductive tapes 46, 48 and 50. The edge containment bracket 16 aligns and clampingly engages the vertical edge margins of the plates 32, 36 and 28 and the tapes 46, 48 and 50 and secures thereto by a plurality of spot welds which penetrate through and join leg 16*a* and the back plate 28; or, in the alternative, rivets can be utilized to accomplish the mutual securing thereof. The edge containment bracket 16 thus is operable to secure adjacent vertical edge margins of the face, back and intermediate plates 32, 28 and 36 against movement outwardly and away from each other.

Similarly configured edge containment brackets, indicated generally at 18 and 20 in FIG. 2, and similar tape combinations along the opposite vertical edge margins and the bottom edge margins of the plates 32, 36 and 28 secure the opposite vertical edge margins and the bottom edge margins of the plates 32, 36 and 28 together. The lower edge of the back plate 28 of the touch-operated signaler 10 has a plurality of drain openings 54 extending therethrough which are substantially aligned with spaces 40 and 44 provided between the tape strips 38*a*–38*n* and 42*a*–42*n* which separate the respective plates in the touch-operated signaler 10.

Referring now to FIG. 4, an elongated flexible top touch plate 56 overlies and extends substantially parallel to the conductive top plate 30 which extends perpendicular to the back plate 28. The rear edge of the touch plate 56 is separated from the top plate 30 by a double thickness of nonconductive, resilient tapes 58 and 60, while the forward edge of the touch plate 56 rests with its forward edge poised and cantileved over the top plate 30 for potential flexed contact with the top plate 30, which of course is electrically and physically contiguous with the back plate 28. The touch plate 56 and neoprene boot 22 are secured to the top plate 30 by one or more edge containment brackets 24*a*–24*n*, similar to previously described edge containment brackets 16, 18 and 20. Edge containment brackets 24*a*–24*n* are secured to the top plate 30 by welds, such as previously described, or, in the alternative, can be riveted or otherwise suitably secured thereto.

The relatively wide angled neoprene rubber boot 22 extends fully along the length of the face plate 32 and upper region of the touch area 12 of the touch-operated signaler 10, with its upper longitudinal edge margin 22*a* overlying and secured to the top plate 30, a compressed stack including nonconductive tapes 58 and 60, the rearward portion of the touch plate 56, nonconductive resilient tape 62 and edge containment brackets 24*a*–24*n*, and its other longitudinal vertically oriented edge margin 22*b* secured to the front of face plate 32 and film 34 by nonconductive tape 64. A plurality of holes 66 distributed along the top plate 30 provide air inlets to the plurality of spaces 40 and 44, as best seen in FIG. 2, between plates 32, 36 and 28, respectively, to relieve vacuum and to aid in draining such regions.

An angled support member 70, having legs 70*a* and 70*b*, is secured to the underside of top plate 30. Leg 70*a* parallels the underside of the top plate 30 and leg 70*b* extends outwardly and downwardly from the rear edge of the top plate 30. This support member 70 provides means for hanging the touch-operated signaler 10 on the lip at the edge of a swimming pool. Alternatively, and referring to FIG. 1, a plurality of bolt holes 72*a*–72*n* are provided extending through the edge containment brackets 16 and 18, and adjacent edge margins of the back plate 28, for use if it is desired to secure the submersible touch-operated signaler 10 to the wall of the pool with bolts.

In operation, the back plate 28 and face plate 32 are in common and electrically connected to a ground connection, and the intermediate plate 36 may be connected to a source of relatively low voltage (in the neighborhood of 0.25 volt). The submersible touch-operated signaler 10 is hung on an end wall of a swimming pool with a major portion of the submersible touch-operated signaler 10 submerged. Water in the pool flows into the spaces 44 and 40 between the plates 32, 36 and 28, respectively, through holes 54 in the back plate 28 at the bottom of the submersible touch-operated signaler 10 and is distributed through spaces 40 and 44 between the tape strips 38*a*–38*n* and 42*a*–42*n*. Air displaced by the water escapes through holes 66 in the top plate 30 in the upper region of the submersible touch-operated signaler 10.

Figure 5:
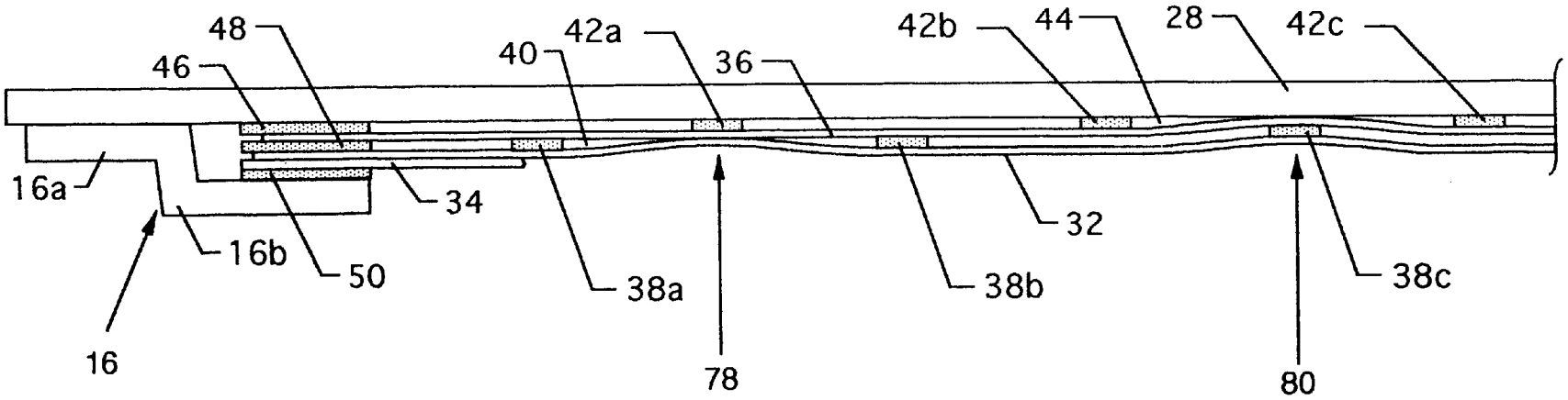
FIG. 5 illustrates depressing of the plates to establish contact for an electrical signal.

As best seen in FIG. 5, a swimmer, on reaching the end of a lap, taps any portion of the touch area 12 which includes the film 34 and face plate 32 or the top of the touch-operated signaler 10 in the region of top touch plate 56 (FIG. 4) to produce a signal which is transmitted to an automatic timer. For clarity of illustration, the full length of the film 34 is not shown. Explaining further, a swimmer's touch on the film 34 and the co-located face plate 32 in the region generally between and exterior to the adjacently located resilient tape strips 38*a* and 38*b* deflects the film 34 and the face plate 32 inwardly, such as shown at arrow 78, whereby the face plate 32 touches the intermediate plate 36 to produce an electrical connection therebetween; or such a touch at or near a site exterior to the adjacently located resilient tape strip 38*c* causes the intermediate plate 36 to deflect inwardly, such as shown at arrow 80, and electrically connect with the back plate 28 due to the coacting deflection of the face plate 32 and film 34 inwardly. A touch on top touch plate 56 deflects the same downwardly and against the top plate 30 to produce an electrical connection therebetween.

When it is desired to remove the touch-operated signaler 10 from the pool, the touch-operated signaler is lifted from the water, at which time fluid which has infiltrated the regions between the plates flows rapidly therefrom through the aligned fluid passages provided by the vertically aligned spaces 40 and 44 between the tapes 38*a*–38*n* and 42*a*–42*n* and through the plurality of openings 54 in the bottom of the back plate 28. As the water drains from the regions between the plates, air enters through holes 66 in the top plate 30 to relieve any vacuum and to promote such draining. This rapid vertical discharge of fluid from the interior of the submersible touch-operated signaler 10 quickly reduces the weight which must be handled, making the submersible touch-operated signaler 10 easier to remove from the pool.

Figure 6:
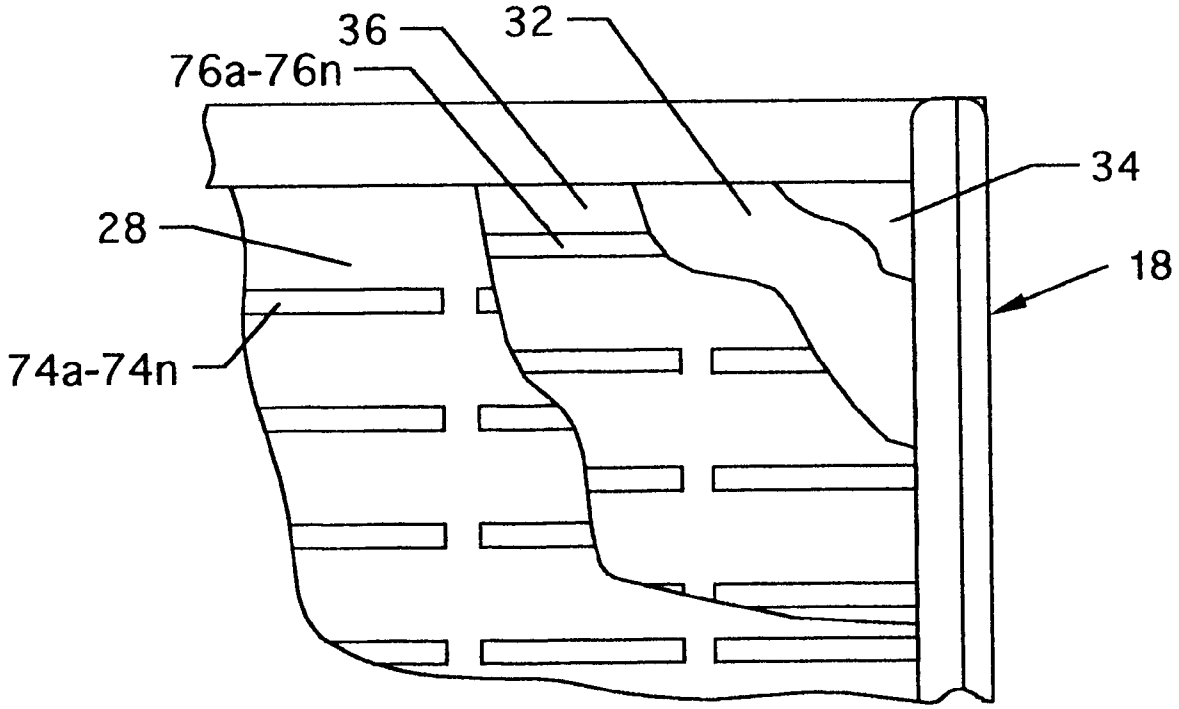
FIG. 6 is a view of an upper corner portion of a modified form of submersible touch-operated signaler with portions broken away; and, FIG. 7 illustrates a block diagram for the invention.

In FIG. 6, an upper corner portion of a modified version of the invention is illustrated. In this version a plurality of vertically spaced, elongated, segmented horizontally aligned nonconductive resilient tape strips 74*a*–74*n* are interposed between back plate 28 and intermediate plate 36. Face plate 32 similarly is spaced from intermediate plate 36 by a plurality of vertically spaced, elongated, segmented horizontal nonconductive resilient tape strips 76*a*–76*n*. The segmented spaces between adjacent strips of tape provide vertical passages for fluid flow from the region bounded by the plates in the touch-operated signaler.

Figure 7:
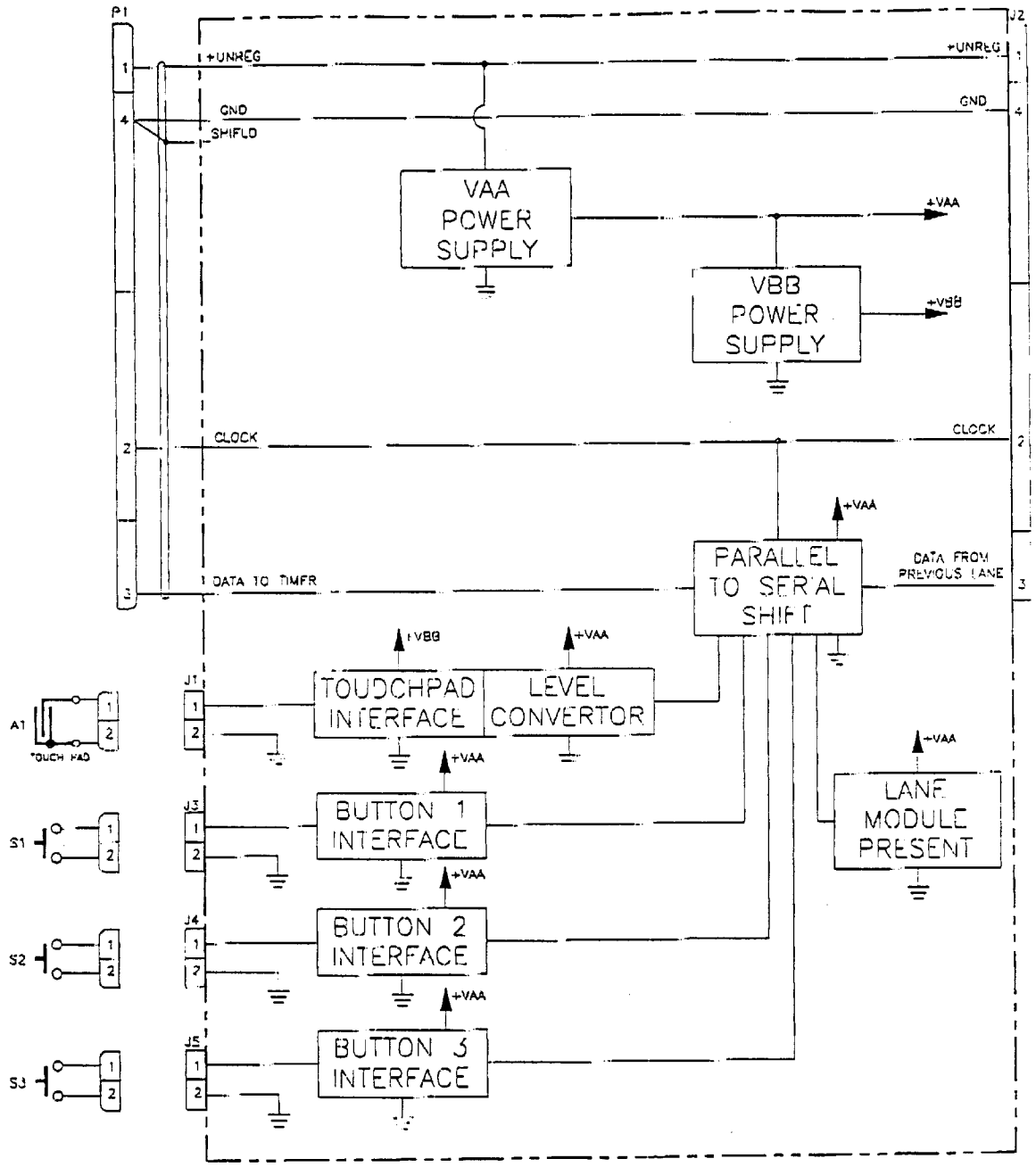

FIG. 7 illustrates a block diagram for the circuitry inside the lane module consisting of a switching power supply, a special purpose shift register, buffers and drivers.

The power supply is based on U1, a 78S40 switching power supply controller chip of FIG. 7. This chip takes in the 12 volt nominal input voltage at relatively low current and generates a nominal 0.25 volt supply for connection to the touch-operated signaler. The desired range of voltage is 0.01 to 0.70 volt. The largest amount of current required by the touch-operated signaler is during "recharge" right after the touch-operated signaler has been touched.

The shift register system has as its hear U6, a 40194 parallel load, serial in/out shift register. A 4013 flip-flop (U2)

is also used to implement a fifth bit of shift register. A total of five data bits are added to the data stream as it goes from one lane module to next and back to the submersible touch-operated signaler. The clock signal, which originated in the lane module timing circuit in the timer, is used to clock the shift register, which brings data from all the lane modules back into the timer. During the delay time between every 58 pulses of the clock signal, U3, a 4098 monistable multi-vibrator, detects the missing pulses and temporarily switches the shift registers from the shift mode into the parallel load mode. The touch-operated signaler inputs, the three button inputs, and the test bit, are loaded into the shift registers. When the clock from the submersible touch-operated signaler resumes again, the shift register returns from the "parallel load" mode to the "shift mode" and all of the data is subsequently shifted back into the timer for recording in memory and further processing by the software.

This circuit utilizes an Op amp (comparator) which is actually part of the U1 switching power supply chip, which was not needed in the power supply configuration. A voltage divider is set during the manufacture of the lane modules to give the proper sensitivity to the touch-operated signaler input. The output of the comparator is fed into Schmidt trigger (U5 pin 11) and then fed into pin 3 of U6 as the first of the five bits of parallel data, to be parallel loaded and serially shifted back to the submersible touch-operated signaler console.

While a preferred and a modified embodiment of the invention have been described herein, it should be obvious to those skilled in the art that further variations and modifications are possible without departing from the spirit of the invention.

PARTS LIST

10 touch-operated signaler
12 touch support
13 upper support region
14 target area
16 edge containment bracket
16*a* leg
16*b* leg
18 edge containment bracket
20 edge containment bracket
22 neoprene boot
22*a* margin
22*b* margin
24*a–n* edge containment brackets
26 terminal enclosure box
28 back plate
30 top plate
32 face plate
34 film
36 intermediate
38*a–n* tape strips
40 spaces
42*a–n* tape strips
44 spaces
46 nonconductive tape
48 nonconductive tape
50 nonconductive tape
54 drain openings
56 touch plate
58 nonconductive tape
60 nonconductive tape
62 nonconductive tape
64 nonconductive tape
66 holes
70 support member
70*a* support member leg
70*b* support member leg
72*a–n* bolt holes
74*a–n* nonconductive strips
76*a–n* nonconductive strips
78 arrow
80 arrow

What is claimed is:

1. A touch-operated signaler for removably mounting on a side of a swimming pool with portions submerged in water in the swimming pool, said touch-operated signaler comprising, in operative condition, a plurality of planar electrically conductive plates for placement into water in a swimming pool; said plurality of planar electrically conductive plates including at least a face plate and a back plate; each planar electrically conductive plate having a top edge, a bottom edge, opposite side edges, and opposite surfaces; said planar electrically conductive plates being oriented with respect to each other such that one of the opposite surfaces of one planar electrically conductive plate confronts one of the opposite surfaces of another planar electrically conductive plate and such that the confronting surfaces are movable toward and away from each other to make and break an electrically conductive connection therebetween; substantially vertically extending electrically non-conductive spacer means interposed between said confronting surface of said planar electrically conductive plates and distributed in spaced apart relationship over said confronting surfaces of said planar electrically conductive plates; said electrically non-conductive spacer means in combination with said planar electrically conductive plates defining a plurality of spaced apart substantially vertically extending passages within which water may flow; means extending along said top, bottom and opposite side edges of said planar electrically conductive plates for securing said top, bottom and opposite side edges of said planar electrically conductive plates against movement away from one another; and a plurality of drain openings in said back plate near the bottom edge of said back plate for allowing water to drain from said substantially vertically extending passages when said planar electrically conductive plates are removed from water in the swimming pool, said drain openings being aligned with said substantially vertically extending passages, wherein said back plate includes a top plate extending rearwardly from its top edge, said top plate having a plurality of holes therethrough for allowing air to escape when submerging said planar electrically conductive plates in water and for allowing air to enter when withdrawing said planar electrically conductive plates from water.

2. The touch-operated signaler as defined in claim 1, wherein said planar electrically conductive plates are connected to a supply voltage of 0.25 volt.

* * * * *